US008950213B2

(12) United States Patent
Mitsuhashi et al.

(10) Patent No.: US 8,950,213 B2
(45) Date of Patent: Feb. 10, 2015

(54) RECEIVER AND RECEIVER-INTEGRATED CONDENSER

(75) Inventors: Takuya Mitsuhashi, Chiryu (JP); Ken Muto, Obu (JP); Akira Itoh, Kariya (JP); Kazuhisa Naito, Kariya (JP); Wei Chen, Chiryu (JP); Hiroyasu Shimanuki, Anjo (JP)

(73) Assignee: Denso Corporation, Kariya (JP)

( * ) Notice: Subject to any disclaimer, the term of this patent is extended or adjusted under 35 U.S.C. 154(b) by 199 days.

(21) Appl. No.: 13/317,947

(22) Filed: Nov. 1, 2011

(65) Prior Publication Data

US 2012/0103007 A1 May 3, 2012

(30) Foreign Application Priority Data

Nov. 3, 2010 (JP) ..... 2010-246944
Aug. 21, 2011 (JP) ..... 2011-180038

(51) Int. Cl.

| | |
|---|---|
| ***F25B 39/04*** | (2006.01) |
| ***F25B 43/04*** | (2006.01) |
| ***F25B 43/00*** | (2006.01) |
| ***F28B 1/00*** | (2006.01) |
| ***F28F 19/00*** | (2006.01) |
| ***F28D 1/06*** | (2006.01) |
| ***F28F 9/02*** | (2006.01) |

(52) U.S. Cl.

CPC ..... *F25B 39/04* (2013.01); *F28F 9/0243* (2013.01); *F25B 2339/0441* (2013.01); *F25B 2339/0442* (2013.01); *F28F 2220/00* (2013.01)

USPC ..... 62/509; 62/474; 62/475; 165/110; 165/119; 165/132

(58) Field of Classification Search

USPC ..... 62/474, 475, 509; 165/119, 132, 110; 96/151

See application file for complete search history.

(56) References Cited

U.S. PATENT DOCUMENTS

| | | | | |
|---|---|---|---|---|
| 2,335,694 | A * | 11/1943 | Paquin et al. | 137/590 |
| 5,557,945 | A * | 9/1996 | Mangyo et al. | 62/474 |
| 6,223,556 | B1 * | 5/2001 | De Keuster et al. | 62/509 |
| 6,341,647 | B1 * | 1/2002 | Nobuta et al. | 165/132 |
| 6,622,517 | B1 * | 9/2003 | Whitlow et al. | 62/474 |
| 6,935,413 | B2 * | 8/2005 | Kamishima et al. | 165/119 |

(Continued)

FOREIGN PATENT DOCUMENTS

| | | |
|---|---|---|
| CN | 101002061 | 7/2007 |
| JP | 9-324962 | 12/1997 |

(Continued)

OTHER PUBLICATIONS

Office action dated Dec. 31, 2013 in corresponding Chinese Application No. 201110343787.8.

*Primary Examiner* — Allen Flanigan
*Assistant Examiner* — Filip Zec
(74) *Attorney, Agent, or Firm* — Harness, Dickey & Pierce, PLC

(57) ABSTRACT

A receiver includes a cylindrical main tank; a cylindrical internal thread component having an internal thread; a cap having a male thread threaded with the internal thread; a sealing attached to the cap; and a filter portion arranged in the cap. The internal thread component is coaxially arranged to an inner circumference face of the tank. The filter portion includes an internal passage extending inside of the cap, and a net that collects a foreign matter contained in refrigerant flowing through the internal passage.

28 Claims, 12 Drawing Sheets

(56) References Cited

U.S. PATENT DOCUMENTS

| | | | | |
|---|---|---|---|---|
| 2002/0101040 | A1* | 8/2002 | Russell | 277/609 |
| 2004/0025532 | A1* | 2/2004 | Scaringe et al. | 62/474 |
| 2008/0006052 | A1* | 1/2008 | Ki et al. | 62/474 |
| 2008/0314252 | A1 | 12/2008 | Min et al. | |

FOREIGN PATENT DOCUMENTS

| | | |
|---|---|---|
| JP | 2001-33121 | 2/2001 |
| JP | 2001-041612 | 2/2001 |

* cited by examiner

RECEIVER AND RECEIVER-INTEGRATED CONDENSER

CROSS REFERENCE TO RELATED APPLICATION

This application is based on Japanese Patent Application No. 2010-246944 filed on Nov. 3, 2010 and Japanese Patent Application No. 2011-180038 filed on Aug. 21, 2011, the disclosures of which are incorporated herein by reference in their entirety.

BACKGROUND OF THE INVENTION

1. Field of the Invention

The present invention relates to a receiver and a receiver-integrated condenser.

2. Description of Related Art

JP-A-2001-33121 describes a receiver having a main tank, an internal thread component, a cap and a filter. The main tank is a container made of metal, and a lower side of the tank has an opening. The internal thread component is made of metal and has a cylindrical shape. An internal thread is defined at a lower end portion of an inner face of the component in an axis direction. The internal thread component is fitted and brazed to an inner face of the main tank at a position adjacent to the opening. A dimension of the internal thread component in the axis direction is approximately the same as that of a combination of the cap and the filter.

The cap is made of resin, and has a column shape. A male thread is defined at a lower end portion of an outer face of the cap in an axis direction. The cap is inserted into the internal thread component, and the internal thread and the male thread are threaded with each other. Further, an 0-ring is mounted to an upper end portion of the cap opposing to the internal thread component, so that a space between inner face of the internal thread component and outer face of the cap is sealed.

The filter has a based cylindrical frame made of resin. Plural openings are defined on an outer circumference face of the frame, and a net is disposed to cover the openings. A bottom side of the filter is connected to an upper end of the cap, so that the cap and the filter are integrally produced.

An upper end portion of the filter is held by the internal thread component. A clearance between outer face of the upper end portion of the filter and inner face of the tank is closed by the internal thread component.

Refrigerant condensed by a condenser flows into the main tank from a position located upper than the filter. The condensed refrigerant is separated into gas and liquid in the main tank. Liquid refrigerant flows through the filter from the upper side, and passes through the net and the opening located on the outer circumference face. Then, refrigerant is discharged out of the tank through a through hole defined in the internal thread component and the tank. A foreign matter contained in refrigerant is caught by the net when refrigerant passes through the filter.

However, thickness and axial dimension of the internal thread component become large because the internal thread is defined on the inner face of the component and because the component works as a holder that holds the cap and the filter. Thus, the receiver becomes heavy, and producing cost of the receiver is increased. In a case where the receiver is integrally brazed to the condenser as a condenser-integrated receiver, if weight of the internal thread component is heavy, heat mass becomes large. In this case, brazing property between the internal thread component and the main tank is lowered, and brazing property between the receiver and the condenser is lowered.

SUMMARY OF THE INVENTION

In view of the foregoing and other problems, it is an object of the present invention to provide a receiver having an internal thread component and a condenser having the receiver, and the internal thread component is made smaller so as to reduce the weight and cost.

According to a first example of the present invention, a receiver for separating refrigerant into gas and liquid includes a cylindrical main tank, a cylindrical internal thread component, a cap, a sealing and a filter portion. The cylindrical main tank has an opening at a longitudinal end. The cylindrical internal thread component has an internal thread on an inner circumference face of an end portion in an axis direction, and is coaxially arranged to an inner circumference face of the tank adjacent to the opening in a manner that the internal thread is located on an inner side of the opening in the axis direction. The cap is coaxially mounted to the component, and has a male thread on an outer circumference face of an end portion in the axis direction. The male thread is threaded with the internal thread. The sealing is mounted to the cap, and seals a clearance between an inner circumference face of the other end portion of the component and an outer circumference face of the other end portion of the cap. The filter portion is defined in the cap, and collects a foreign matter contained in liquid refrigerant while the liquid refrigerant passes through the filter portion before flowing out of the tank. The filter portion includes an internal passage and a net. The internal passage extends inside of the cap from an axial end of the cap to outside of the cap located between the male thread and the sealing in the axis direction. The net collects the foreign matter contained in liquid refrigerant while the liquid refrigerant flows through the internal passage.

According to a second example of the present invention, a receiver for separating refrigerant into gas and liquid includes a cylindrical main tank, a cylindrical internal thread component, a cap, a sealing, a filter portion and a ring-shaped board member. The cylindrical main tank has an opening at a longitudinal end. The cylindrical internal thread component has an internal thread on an inner circumference face of an end portion in an axis direction, and is coaxially arranged to an inner circumference face of the tank adjacent to the opening in a manner that the other end portion of the component is located on an inner side of the opening in the axis direction. The cap is coaxially mounted to the component, and has a male thread on an outer circumference face of an end portion in the axis direction. The male thread is threaded with the internal thread. The sealing is mounted to the cap, and seals a clearance between an inner circumference face of the other end portion of the component and an outer circumference face of the other end portion of the cap. The filter portion is defined on a tip end of the cap in an inserting direction in which the cap is inserted into the component. The filter portion collects a foreign matter contained in liquid refrigerant while the liquid refrigerant passes through the filter portion before flowing out of the tank. The filter portion includes a main part and a net. The main part has a tube shape with a bottom opposing to the cap and an inlet opening opposite from the bottom in the axis direction. A through hole is defined in an outer circumference face of the tube-shaped main part. The net collects the foreign matter contained in liquid refrigerant while the liquid refrigerant flows through the main part from the inlet opening to the through hole. The ring-shaped board member closes a clearance defined between outer circumference face of the main part adjacent to the inlet opening and inner circumference face of the tank in a radial direction.

According to a third example of the present invention, a receiver-integrated condenser includes the receiver of the first or second example and a condenser that condenses refrigerant.

The above and other objects, features and advantages of the present invention will become more apparent from the following detailed description made with reference to the accompanying drawings. In the drawings:

DETAILED DESCRIPTION OF PREFERRED EMBODIMENT (First Embodiment)

A receiver-integrated condenser 10 of a first embodiment will be described with reference to FIGS. 1-5. The receiver-integrated condenser 10 constructs a refrigerating cycle of an air-conditioner for a vehicle. High-temperature and high-pressure refrigerant discharged from a compressor is condensed by cooling when heat exchange is performed with outside air. The condensed refrigerant is separated into gas and liquid. Further, liquid phase refrigerant is supercooled by the heat exchange with outside air.

The refrigerating cycle is a closed circuit which is defined by connecting the compressor, the receiver-integrated condenser 10, an expansion valve, and an evaporator, for example, using refrigerant piping.

The receiver-integrated condenser 10 is mounted to the vehicle through a mounting bracket (not shown) at a place which is easy to receive wind in an engine compartment. Usually, the condenser 10 is located at front side of a radiator for cooling engine-cooling-water.

Figure 1:
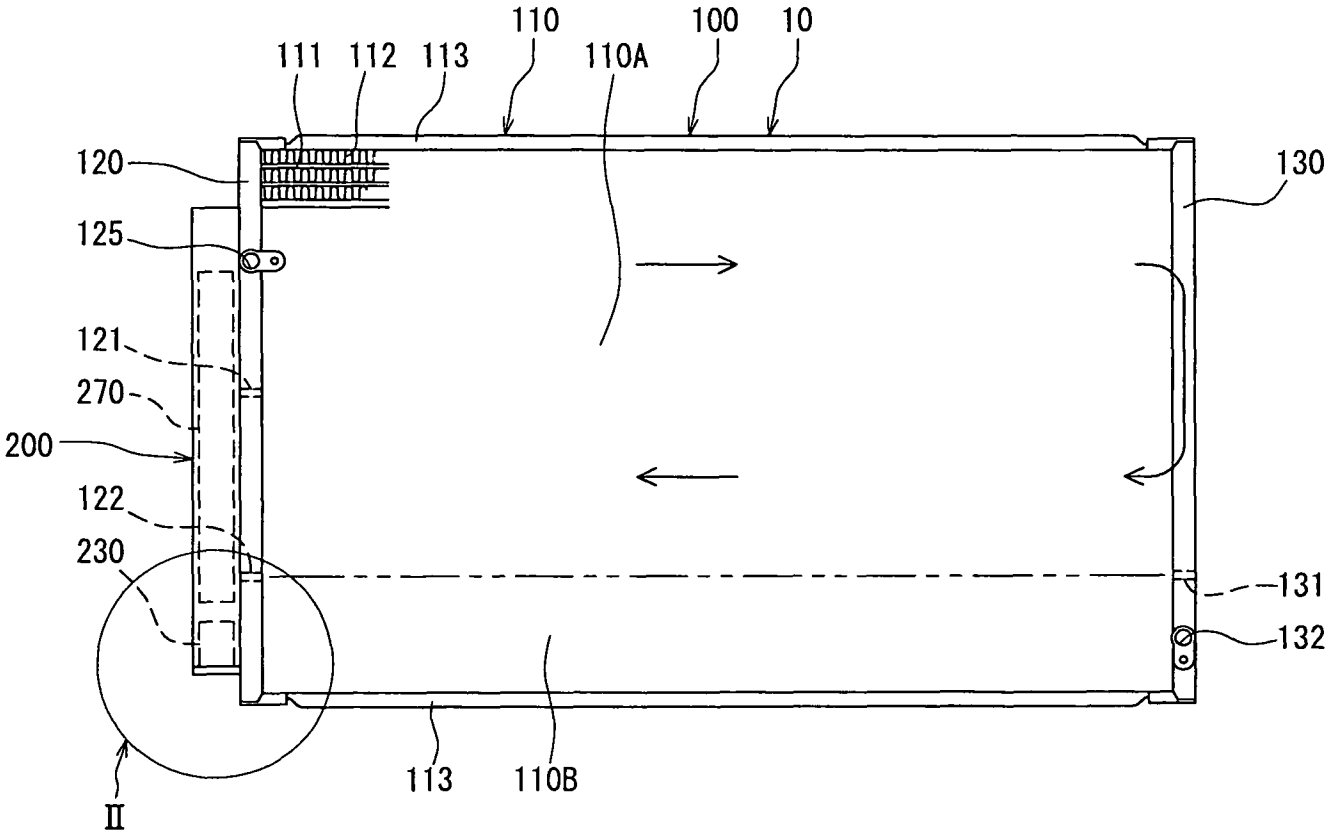
FIG. 1 is a schematic front view illustrating a receiver-integrated condenser according to a first embodiment.

As shown in FIG. 1, the receiver-integrated condenser 10 has a condenser 100 and a receiver 200. Components which constructs the receiver-integrated condenser 10 are made of aluminum material or aluminum alloy material, except for a cap 230, a net 251, and desiccating agent 270 of the receiver 200. After the components are temporary assembled, integral brazing is performed in furnace.

The condenser 100 has a core part 110, a left header tank 120, and a right header tank 130. The core part 110 is a heat exchange part in which heat is exchanged between refrigerant and outside air, and has a condensation part 110A and a supercooling part 110B.

The condensation part 110A is arranged at upper part in the core part 110, and the supercooling part 110B is arranged under the condensation part 110A. The condensation part 110A and the supercooling part 110B are defined by alternately layering tubes 111 and corrugated fins 112 in up-and-down direction corresponding to a layering direction. Each of the tube 111 and the fin 112 extends horizontally.

A side plate 113 corresponding to a reinforcement component is arranged to the fin 112 located most outside in the layering direction. For example, the side plate 113 is arranged on the upper end of the condensation part 110A and on the lower end of the supercooling part 110B, respectively. The tube 111, the fin 112, and the side plate 113 are joined with each other at their contact position by brazing.

The left header tank 120 is a cylindrical tank which extends in the up-and-down direction on the left end of the core part 110. Left ends of the tubes 111 are connected to the tank 120. Separators 121, 122 are arranged in the left header tank 120, and inside of the left header tank 120 is divided into three spaces in the up-and-down direction by the separators 121, 122. In the core part 110, the condensation part 110A is defined above the separator 122, and the supercooling part 110B is defined below the separator 122.

Figure 2:
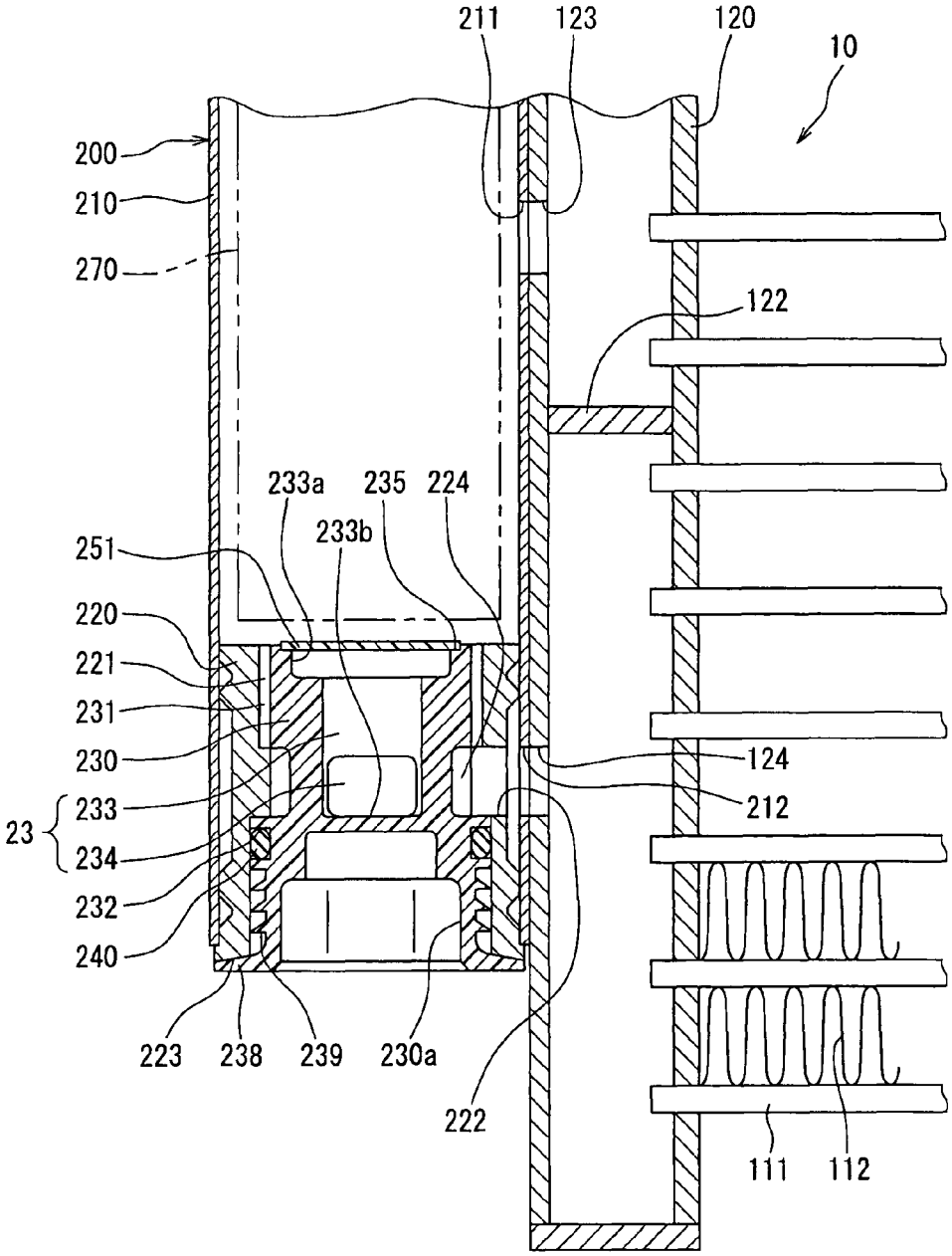
FIG. 2 is a schematic enlarged cross-sectional view of an area II of FIG. 1.

As shown in FIG. 2, a through hole 123 is defined in a wall part of the left header tank 120 opposite from the tube 111. The hole 123 is located between the separators 121, 122 in the layering direction, and the condensed liquid refrigerant flows out of the tank 120 through the hole 123.

Further, a hole 124 is defined in the wall part of the left header tank 120. The hole 124 is located lower than the separator 122, and liquid refrigerant flowing out of the receiver 200 enters the tank 120 through the hole 124.

As shown in FIG. 1, an inlet connector 125 is arranged on a side face of the tank 120 at the upper side of the separator 121. Refrigerant with high-temperature and high-pressure discharged out of the compressor flows into the left header tank 120 through the connector 125.

The right header tank 130 is a cylindrical tank which extends in the up-and-down direction on the right end of the core part 110. Right ends of the tubes 111 are connected to the tank 130. A separator 131 is arranged in the right header tank 130, and inside of the tank 130 is divided into two spaces in the up-and-down direction by the separator 131. The separator 131 is located at the same position with the separator 122 in the up-and-down direction, and separates the core part 110 into the condensation part 110A and the supercooling part 110B.

An outlet connector 132 is arranged on a side face of the tank 130 at the lower side of the separator 131. Refrigerant supercooled by the supercooling part 110B is discharged out of the right header tank 130 through the connector 132.

The receiver 200 is a storage portion to store refrigerant which circulates in the refrigerating cycle. The receiver 200 also works as a separator that separates refrigerant flowing out of the condensation part 110A into gas and liquid. After a foreign matter contained in refrigerant is caught in a net 251 shown in FIG. 2, only the liquid refrigerant is supplied to the supercooling part 110B.

As shown in FIG. 2, the receiver 200 has a main tank 210, an internal thread component 220, a cap 230, and desiccating agent 270 in addition to the net 251 corresponding to a filter portion.

The tank 210 is a based cylindrical tank, and a longitudinal end of the tank 210 has an opening. The tank 210 is joined to the wall part of the left header tank 120 in a manner that the opening is located on the lower side. A through hole 211 is defined in a right face of the tank 210 at a position corresponding to the hole 123 of the tank 120. A middle space of the left header tank 120 in the up-and-down direction and inside of the tank 210 communicate with each other through the hole 211. A through hole 212 is defined in the right face of the tank 210 at a position corresponding to the hole 124 of the tank 120. A lower space of the left header tank 120 in the up-and-down direction and inside of the tank 210 communicate with each other through the hole 212.

The internal thread component 220 is a component having an internal thread 221, and the internal thread 221 is defined on an inner circumference face of the component 220. For example, the component 220 is a member produced separately from the tank 210.

As shown in FIG. 2, the internal thread component 220 is a cylindrical component into which the cap 230 is mounted. Plural slots extending in a circumference direction are defined on outer periphery of the component 220 in the axis direction. The internal thread 221 is defined on an end portion of the inner circumference face of the component 220 in the axis direction.

A through hole 222 is defined in the internal thread component 220 at intermediate position in the axis direction, and extends perpendicularly to the axis direction. The hole 222 is located to oppose the hole 212 of the main tank 210. The other end portion 223 of the internal thread component 220 in the axis direction has a taper shape. Specifically, a length in the axis direction becomes longer as going outward in a radial direction in the lower end portion 223 of the component 220.

The internal thread component 220 is arranged to the inner circumference face of the main tank 210 adjacent to the opening of the main tank 210 in a manner that the internal thread 221 is located inner side than the opening of the main tank 210 in the axis direction. That is, the internal thread component 220 is inserted from the opening of the tank 210 to a position at which the lower end portion 223 of the component 220 approximately agrees with the opening of the main tank 210. At this insertion time, the internal thread 221 is located on front (tip) side, and the lower end portion 223 is located on rear side. Thus, the inner face of the tank 210 and the outer face of the internal thread component 220 are joined with each other. The outer face of the internal thread component 220 may be constructed by convex part of the slots. Hereafter, the lower end portion 223 will be defined as a rear end 223.

Figure 3:
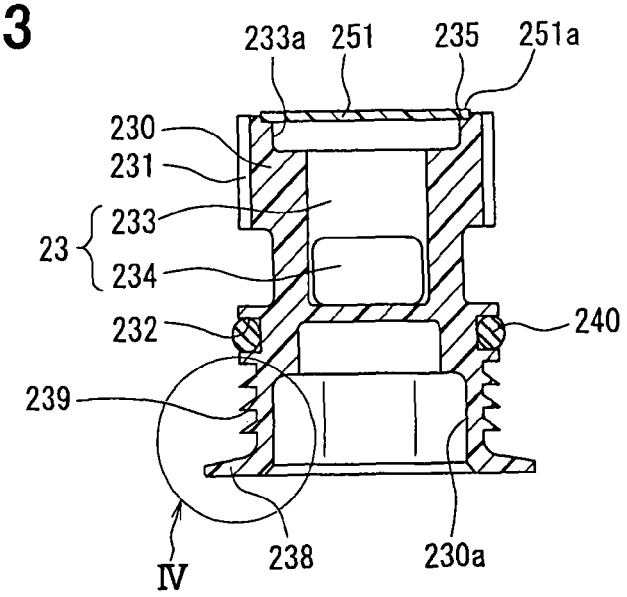
FIG. 3 is a cross-sectional view illustrating a cap of a receiver of the receiver-integrated condenser.

As shown in FIG. 3, the cap 230 is a cylindrical lid component which closes the opening of the tank 210, and is fitted with the internal thread component 220 by the insertion. The cap 230 is made of resin excellent in deterioration resistance against refrigerant and oil and excellent in heat resistance. The oil for lubricating the compressor circulates in the refrigerating cycle with refrigerant. For example, the cap 230 is made of nylon, polyester, etc. A dimension of the cap 230 is set approximately the same as that of the internal thread component 220 in the axis direction. The internal thread component 220 and the cap 230 are mounted to be approximately overlap with each other in the axis direction.

A male thread 231 to be threaded with the internal thread 221 is defined in an upper end portion of the cap 230 in the axis direction. Moreover, an O-ring groove 232 is defined in the cap 230 at intermediate position in the axis direction, and an O-ring 240 is attached to the groove 232 as a sealing.

An internal passage 23 is defined in the cap 230, and extends from an upper axial end of the cap 230. The passage 23 passes inside of the cap 230, and communicates with outside at a position between the male thread 231 and the O-ring groove 232 (O ring 240) in the axis direction. The internal passage 23 has a first passage 233 and a second passage 234.

The first passage 233 extends in the axis direction from the axial end of the cap 230 to a middle position inside of the cap 230. The first passage 233 has an opening 233*a* and a termination wall 233*b*. The opening 233*a* is open in the upper axial end of the cap 230. The wall 233*b* is a dead end of the passage 233 opposite from the opening 233*a*.

The second passage 234 extends from the termination wall 233*b* of the first passage 233, and has an opening open in the outer circumference face of the cap 230. The opening is located between the male thread 231 and the O-ring groove 232 in the axis direction. Two of the second passages 234 may be defined so as to extend opposite from each other in the radial direction. Alternatively, the number of the second passages 234 is at least one.

The cap 230 has a small diameter part in which a diameter of the cap 230 is set smaller than the other part in the axis direction. The second passage 234 is defined at the small diameter part located between the male thread 231 and the O-ring groove 232 in the axis direction. As shown in FIG. 2, a clearance 224 is defined between an outer face of the small diameter part and the inner face of the internal thread component 220. The clearance 224 communicates with the hole 222 of the internal thread component 220.

A recess 235 is defined around the opening 233*a* of the first passage 233. An inner diameter of the recess 235 is set greater than that of the opening 233*a*. The recess 235 defines a predetermined amount of step recessed in the axis direction. The net 251 has a flat disc shape, and is fitted into the recess 235.

Figure 4A:
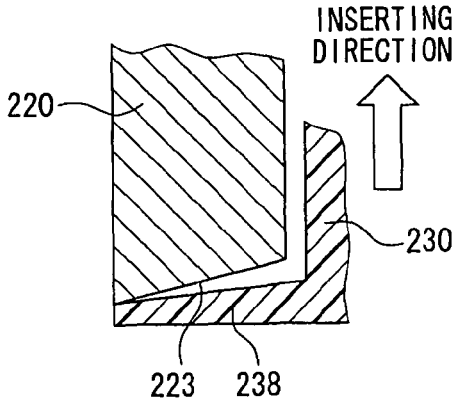
FIGS. 4A and 4B are enlarged cross-sectional views of an area IV of FIG. 3.
Figure 4B:
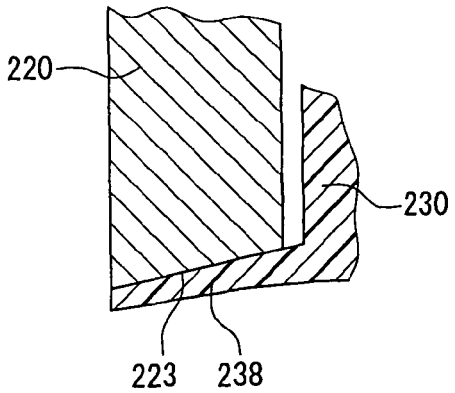

The other (lower) axial end of the cap 230 has a flange 238 extending outward in the radial direction. A thickness dimension of the flange 238 is set to become smaller as extending outward in the radial direction. As shown in FIGS. 4A and 4B, a tip side portion of the flange 238 can be distorted in the axis direction. A face of the flange 238 opposing to the rear end 223 of the internal thread part 220 is tapered in which the thickness of the flange 238 becomes smaller as extending outward in the radial direction.

As shown in an arrow direction of FIG. 4A indicating an inserting direction, when the internal thread 221 and the male thread 231 are threaded with each other by inserting the cap 230 into the internal thread component 220, the flange 238 is distorted in the axis direction, as shown in FIG. 4B. The distorted flange 238 has tight face-contact with the tapered rear end 223 of the internal thread component 220, so that there is no clearance between the internal thread component 220 and the cap 230.

The outer face of the cap 230 located between the 0-ring groove 232 and the flange 238 in the axis direction has a waterproof seal 239 made of ridges and grooves. The seal 239 extends outward in the radial direction, and is integrally molded with the cap 230 using the same resin material.

Figure 5:
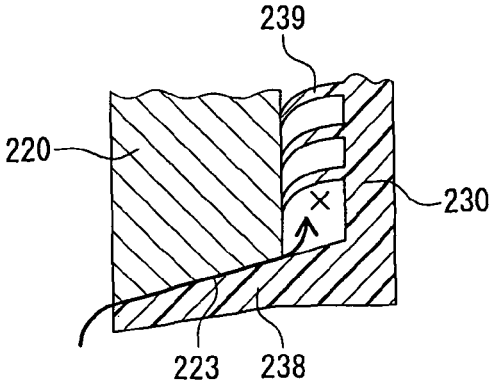
FIG. 5 is a cross-sectional view illustrating a waterproof seal located between an internal thread component and the cap in the receiver.

A radial dimension of the seal 239 is set larger than a clearance dimension defined between the outer face of the cap 230 having the seal 239 and the inner face of the internal thread component 220 opposing with each other. As shown in FIG. 5, a tip of the seal 239 is distorted and contacted to the inner face of the internal thread component 220 with reliability, so as to seal the space between the inner face of the internal thread component 220 and the outer face of the cap 230. Thus, permeation of water coming from outside can be prevented.

The seal 239 may be made of resin material whose hardness is lower than the resin material used for molding the cap 230. In this case, the seal 239 may be integrally molded with the cap 230 using double injection.

As shown in FIG. 3, a concave portion 230*a* is defined at the other end portion of the cap 230 located on the lower side in the axis direction, and is recessed inward. Due to the concave portion 230*a*, the thickness of the cap 230 is made uniform as the whole, and a hexagonal wrench can be inserted into the concave portion 230*a* when the internal thread 221 and the male thread 231 are connected with or disconnected from each other.

The net 251 is constructed by minute mesh, and catches a foreign matter such as dust contained in refrigerant. The net 251 is made of the same resin material as the cap 230. The net 251 is fitted into the recess 235 so as to cover the opening 233*a* of the cap 230, and an outer periphery 251*a* of the net 251 is welded to the recess 235 of the cap 230.

The net 251 constructs the filter portion together with the internal passage 23 having the first passage 233 and the second passage 234. That is, surroundings of the internal passage 23 of the cap 230 may work as a frame portion. The filter portion is defined by arranging the net 251 above the opening 233*a* of the internal passage 23 corresponding to the frame portion.

The desiccating agent 270 is produced by storing granular zeolite inside a bag, and absorbs moisture in refrigerant. Therefore, components constructing the refrigerating cycle can be restricted from corroding by moisture, or refrigerant flow can be restricted from stopping because freezing of moisture is not generated in pores of the expansion valve. As shown in FIG. 2, the desiccating agent 270 is accommodated in the tank 210 at a space located upper than the internal thread component 220 and the cap 230.

Next, operation of the receiver-integrated condenser 10 is described below.

High-temperature and high-pressure gas refrigerant flowing out of the compressor in the refrigerating cycle flows into the upper space of the left header tank 120 through the connector 125. As shown in arrow directions of FIG. 1, refrigerant flows through upper side of the condensation part 110A, the right header tank 130, and lower side of the condensation part 110A in this order. Refrigerant flowing into the middle space in the tank 120 is condensed by being cooled by outside air, and is saturated into saturated refrigerant containing gas refrigerant. As shown in FIG. 2, the saturated refrigerant flows from the middle space in the left header tank 120 into the main tank 210 through the hole 123, 211, and is separated into gas and liquid in the tank 210. At the same time, moisture of refrigerant flowing into the tank 210 is absorbed by the desiccating agent 270.

Liquid refrigerant flows into the lower space in the left header tank 120 through the net 251, the internal passage 23 constructed by the passages 233, 234, the clearance 224, the hole 222 of the internal thread component 220, the hole 212 of the tank 210 and the hole 124 of the tank 120. While refrigerant passes through the net 251, a foreign matter such as dust contained in refrigerant is collected by the net 251. Further, liquid refrigerant is supercooled while flowing through the supercooling part 1108, and flows out of the right header tank 130 through the connector 132.

According to the first embodiment, the internal passage 23 is defined in the cap 230 between the male thread 231 and the O-ring 240. The cap 230 has the net 251 that collects the foreign object contained in refrigerant flowing through the passage 23. Thus, the filter portion can be formed to filter the refrigerant flowing out of the tank 210.

Due to the construction of the filter portion, the periphery of the internal passage 23 of the cap 230 can be used as a frame portion of a conventional filter portion. In the conventional filter portion, the frame portion is arranged on a tip side of the cap. In contrast, according to the first embodiment, the frame portion of the conventional filter portion is unnecessary, so that axial dimension of the cap 230 can be made shorter by the dimension of the conventional filter portion. Therefore, total length of the internal thread component 220 holding the cap 230 and the filter portion can be made short, so that the weight and cost of the component 220 can be reduced.

The internal thread component 220 and the tank 210 are produced separately from each other. The component 220 is inserted into the tank 210, and is welded to the inner face of the tank 210 adjacent to the opening of the tank 210. Therefore, the tank 210 is not necessary to have a large thickness part that partially has a large thickness for defining an internal thread part integrally, so that the tank 210 can have simple tube shape. The internal thread 221 can be easily formed by fixing the internal thread component 220 to the tank 210, and processing cost of the tank 210 can be reduced.

The net 251 has the round flat shape, and is arranged on the upper end of the cap 230 so as to cover the opening 233*a* of the internal passage 23. Therefore, the net 251 can be made simple and small.

Further, the cap 230 has the recess 235 around the opening 233*a* to which the net 251 is fitted and welded. Therefore, positioning of outer periphery 251*a* of the net 251 can be easily performed by fitting the net 251 into the recess 235. Thus, arrangement and welding of the net 251 can be easily performed relative to the cap 230.

The cap 230 is made of resin material. Compared with a case where the cap is made of metal, weight and cost of the cap 230 can be reduced.

The flange 238 of the cap 230 is tightly face-contact to the rear end 223 of the component 220. Therefore, fluid coming from outside can be restricted from entering a clearance between the inner face of the component 220 and the outer face of the cap 230.

The seal 239 is arranged between the flange 238 and the 0-ring 240 in the axis direction, and seals the clearance between the inner face of the component 220 and the outer face of the cap 230. Even if tightness degree between the flange 238 and the rear end 223 is lowered by ages, as shown in FIG. 5, water invasion from the rear end 223 to the O-ring 240 can be restricted by the seal 239. Thus, the inner face of the component 220 can be restricted from having corrosion, especially at a clearance adjacent to the O-ring 240.

The seal 239 is made of the same resin material as the cap 230, and is integrally molded with the cap 230. Alternatively, the seal 239 is made of resin material whose hardness is lower than that of the cap 230, and is produced by double injection. Therefore, the seal 239 can be easily formed with the cap 230.

The male thread 231 is defined on the upper tip portion of the cap 230 in the axis direction, and the O-ring 240 is mounted to the cap 230 adjacent to the rear end 233. Therefore, while the cap 230 is mounted to the component 220, the O-ring 240 is prevented from interfering with the internal thread 221, so that the O-ring 240 is restricted from being damaged.

The recess 235 may be eliminated, while the net 251 is arranged to cover the opening 233*a* of the first passage 233.

(Second Embodiment)

Figure 6:
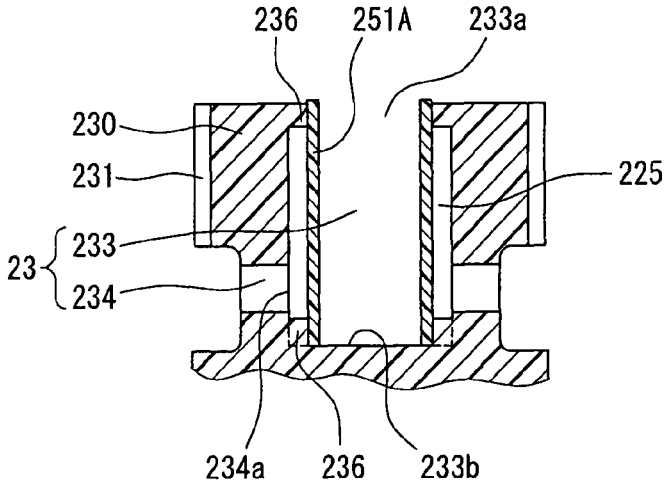
FIG. 6 is a cross-sectional view illustrating a cap of a receiver according to a second embodiment.

A cap 230 of a second embodiment will be described with reference to FIG. 6. The shape of the net 251 of the first embodiment is modified into a net 251A in the second embodiment.

The net 251A is made of the same resin material as the cap 230, and has a cylindrical shape. The net 251A is arranged in the first passage 233, and axial dimension of the net 251A is approximately the same as the first passage 233. Further, an outer diameter dimension of the net 251A is approximately the same as an inner diameter dimension of a ring-shaped projection 236.

The projection 236 is projected from an inner wall of the first passage 233 in the radial direction of the first passage 23, and extends in the circumference direction. In the second embodiment, the recess 235 of the first embodiment is eliminated. The projection 236 is defined around the inner wall of the first passage 233 adjacent to the opening 233*a* and the termination wall 233*b*, respectively. The two positions of the projection 236 correspond to the axial ends of the net 251A.

The axial end portions of the net 251A are contact with the projection 236, and are connected to the projection 236 by welding. The net 251A is arranged to cover an inner opening 234*a* of the second passage 234. A clearance 225 is defined between the net 251A and the inner wall of the first passage 233 in the radial direction, due to the projection 236.

Liquid refrigerant flows into the net 251A from the opening 233*a* of the first passage 233, and passes into the left header tank 120 through the second passage 234.

At this time, while refrigerant flows from the first passage 233 to the second passage 234, refrigerant passes through the clearance 225 defined between the net 251A and the inner wall of the first passage 233, so that refrigerant flows through the whole surface of the tube-shaped net 251A. Thus, a foreign matter contained in refrigerant can be effectively collected.

The projection 236 and the net 251A are not limited to have the above constructions. The projection 236 may be defined around only one of the inner wall of the first passage 233 adjacent to the opening 233*a* and the inner wall of the first passage 233 adjacent to the termination wall 233*b*. That is, in this case, a first end portion of the net 251A in the axis direction is welded to the projection 236, and a second end portion of the net 251A in the axis direction is welded to the inner wall of the first passage 233.

In this case, a clearance can be formed between the net 251A and the inner wall of the first passage 233, so that refrigerant passes over the whole surface of the net 251A. Thus, the foreign matter can be effectively collected.

For example, the projection 236 may be eliminated, and the net 251A may be directly welded to the inner face of the first passage 233, while the clearance 225 is not defined.

(Third Embodiment)

A cap 230 of a third embodiment will be described with reference to FIG. 7. The shape of the net 251 of the first embodiment is modified into a net 251B in the third embodiment.

The net 251B is made of the same resin material as the cap 230, and has a cone shape. The net 251B is arranged in the first passage 233 in a manner that a tip (top) end of the cone shape opposes downward and that a bottom side of the cone shape opposes upward. An outer diameter dimension of a circumference of the net 251B on the bottom side is approximately the same as an inner diameter dimension of the first passage 233. Further, axial dimension of the net 251B is approximately the same as the first passage 233. The net 251B has a flange 251*b* extending outward in the radial direction from outer periphery of the circumference of the net 251B on the bottom side.

A recess 235 is defined on the axial end of the cap 230 around the opening 233*a* of the first passage 233, similarly to the first embodiment. The flange 251*b* is fitted to the recess 235. Further, a projection 237 is projected from a center of a termination wall 233*b* of cap 230 toward the opening 233*a*. The terminal wall 233*b* is located at a termination of the first passage 233.

The flange 251*b* is inserted and welded to the recess 235. The top end of the net 251B is welded to the projection 237, thereby the net 251B is connected to the cap 230 inside of the first passage 233.

Liquid refrigerant flows into the net 251B from the opening 233*a* of the first passage 233, and passes into the left header tank 120 through the second passage 234.

According to the third embodiment, the flange 251*b* is defined on the bottom side of the cone-shaped net 251B, and is inserted and welded into the recess 235 of the cap 230. Therefore, the positioning of the net 251B can be easily performed, and the net 251B is easily welded to the cap 230.

Further, the welding is performed in a state that the top end of the net 251B is contacted with the projection 237. Therefore, it is easy to focus and concentrate to the projection 237 as the welding position, and the top end of the net 251B can be easily welded. Thus, the cone-shaped net 251B can be fixed to the cap 230 in stable state.

Alternatively, the flange 251*b* may be eliminated. In this case, the projection 236 of the second embodiment may be defined on an inner wall of the first passage 233 around the opening 233*a*. An outer periphery of the bottom side of the cone-shaped net 251B may be welded to the projection 236. Therefore, it is easy to focus and concentrate to the projection 236 as the welding position, and the outer periphery of the bottom side of the net 251B can be easily welded.

Alternatively, the flange 251*b*, the recess 235 and the projection 237 may be eliminated. In this case, the net 251B may be directly welded to the inner wall or the termination wall 233*b* of the first passage 233.

(Fourth Embodiment)

Figure 8:
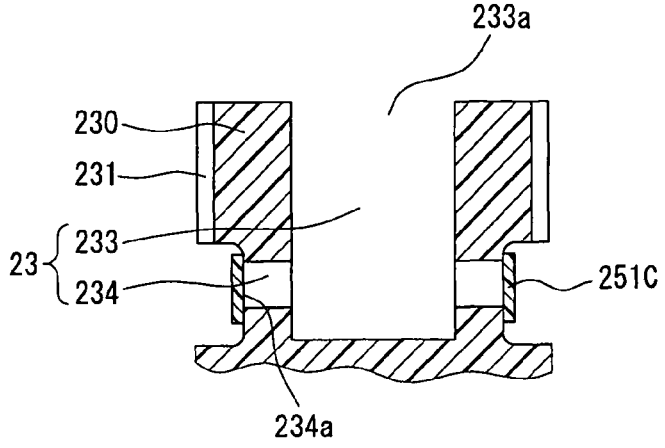
FIG. 8 is a cross-sectional view illustrating a cap of a receiver according to a fourth embodiment.

A cap 230 of a fourth embodiment will be described with reference to FIG. 8. The shape of the net 251 of the first embodiment is modified into a net 251C in the fourth embodiment.

The net 251C is made of the same resin material as the cap 230, and is arranged on outer circumference of the small diameter part of the cap 230 so as to cover an outer opening 234*a* of the second passage 234. For example, the net 251C is formed into a board shape having an area larger than an area of the opening 234*a*, and is arranged to cover the opening 234*a*. In this state, the net 251C is welded to the outer periphery of the small diameter part of the cap 230. Alternatively, the net 251C may be formed into a band shape, and is wound around the outer periphery of the small diameter part of the cap 230 so as to cover the opening 234*a*. In this state, the net 251C is welded to the outer periphery of the small diameter part of the cap 230.

According to the fourth embodiment, the net 251C is welded to the outer circumference face of the cap 230. Liquid refrigerant flows into the cap 230 from the opening 233*a* of the first passage 233, and passes into the left header tank 120 through the second passage 234 and the net 251C. Thus, the same advantages can be obtained as the first embodiment.

(Fifth Embodiment)

Figure 9:
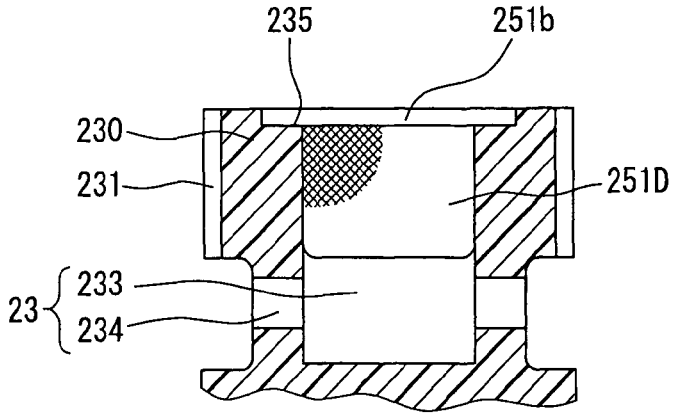
FIG. 9 is a cross-sectional view illustrating a cap of a receiver according to a fifth embodiment.

A cap 230 of a fifth embodiment will be described with reference to FIG. 9. The shape of the net 251 of the first embodiment is modified into a net 251D in the fifth embodiment.

The net 251D is made of the same resin material as the cap 230, and has a based tube shape. Opening side of the net 251D has a disc-shaped flange 251*b* extending outward in the radial direction.

Similarly to the first embodiment, the recess 235 is defined on the axial end of the cap 230 around the opening 233*a* of the first passage 233. An inner diameter of the recess 235 is slightly smaller than an outer diameter of the flange 251*b*. A mesh part of the net 251D is arranged in the first passage 233. Further, the flange 251*b* is fitted to the recess 235, thereby connecting the net 251D to the cap 230.

According to the fifth embodiment, liquid refrigerant flows into the cap 230 from the opening 233*a* of the first passage 233, and passes into the left header tank 120 through the net 251D and the second passage 234. Thus, welding is unnecessary in this embodiment, and the net 251D can be mounted to the cap 230 by single arrangement operation without the welding.

(Sixth Embodiment)

Figure 10:
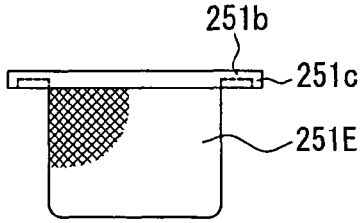
FIG. 10 is a side view illustrating a net of a receiver according to a sixth embodiment.
Figure 11:
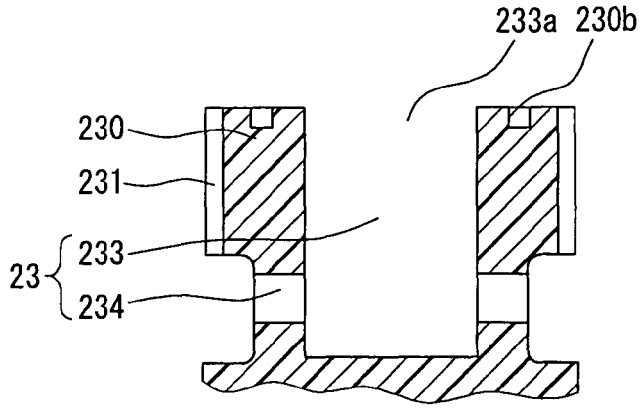
FIG. 11 is a cross-sectional view illustrating a cap of the receiver of the sixth embodiment.
Figure 12:
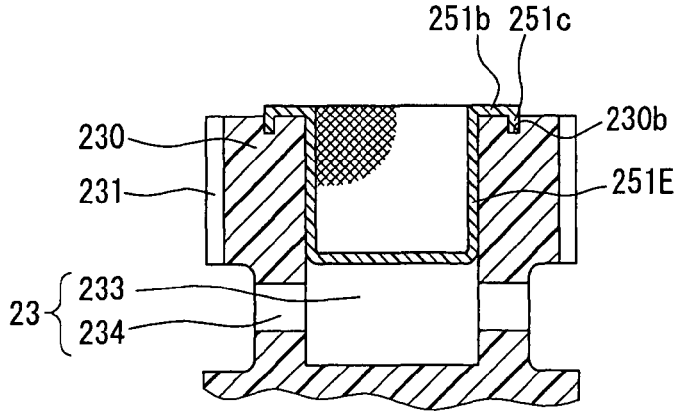
FIG. 12 is a cross-sectional view illustrating the cap and the net of the sixth embodiment.

A cap 230 of a sixth embodiment will be described with reference to FIGS. 10-12. The shape of the net 251D of the fifth embodiment is modified into a net 251E in the sixth embodiment, and a fitting state between the net 251E and the cap 230 is modified from the fifth embodiment.

The net 251E is made of the same resin material as the cap 230, and has a based tube shape. Opening side of the net 251D has a disc-shaped flange 251*b* extending outward in the radial direction. Further, a ring-shaped projection 251*c* is projected from outer periphery of the flange 251*b* toward the cap 230.

The axial end face of the cap 230 adjacent to the opening 233*a* has a ring-shaped recess 230*b* corresponding to the projection 251*c*. A dimension of the projection 251*c* in the radial direction is slightly larger than that of the recess 230*b* in the radial direction. A mesh part of the net 251E is arranged in the first passage 233. Further, the flange 251*c* is fitted to the recess 230*b*, thereby connecting the net 251E to the cap 230.

According to the sixth embodiment, similarly to the fifth embodiment, liquid refrigerant flows into the cap 230 from the opening 233*a* of the first passage 233, and passes into the left header tank 120 through the net 251E and the second passage 234. Thus, welding is unnecessary in this embodiment, and the net 251E can be mounted to the cap 230 by single arrangement operation without the welding.

(Seventh Embodiment)

Figure 13:
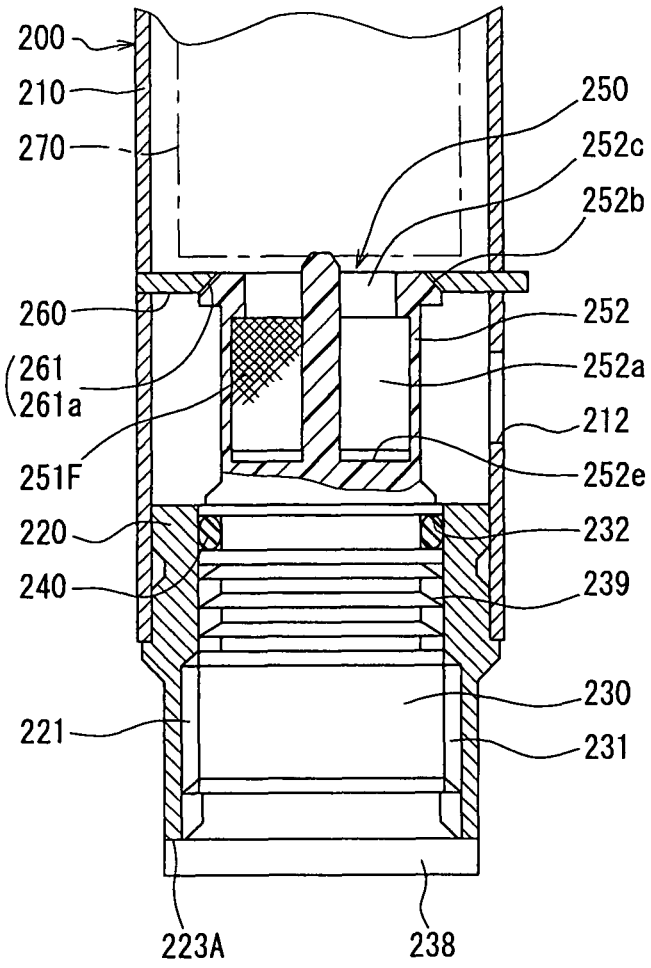
FIG. 13 is a cross-sectional view illustrating a receiver according to a seventh embodiment.
Figure 14:
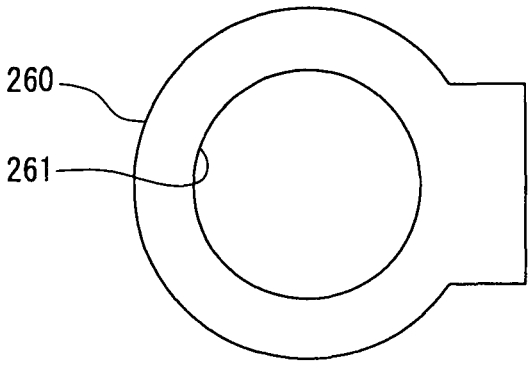
FIG. 14 is a plan view illustrating a separator of the receiver of the seventh embodiment.

A seventh embodiment will be described with reference to FIGS. 13 and 14. A filter portion 250 is arranged on an upper end of the cap 230 in the axis direction, and a separator 260 closes a clearance between an upper end of the filter portion 250 and the main tank 210 in the radial direction.

Approximately half of the component 220 is located in the tank 210 in the axis direction, and is welded to an inner circumference face of the tank 210. An internal thread 221, is defined on a rear (lower) end portion of the component 220. A read end 223A of the component 220 is a plane extending approximately perpendicular to the axis direction. The through hole 222 of the first embodiment is not defined in the component 220 in this embodiment.

The cap 230 has a column shape, and a tip (upper) side of the cap 230 has a diameter smaller than that of a rear (lower) side of the cap 230. The tip side of the cap 230 has a recess 232, and an O-ring 240 is fitted to the recess 232. The O-ring 240 seals a clearance between an inner circumference face of the component 220 and an outer circumference face of the cap 230 on the tip side. A male thread 231 is defined on the rear end portion of the cap 230, and is threaded with the internal thread 221 of the internal thread component 220. The read end of the cap 230 has a flange 238, and the flange 238 is contacted with the rear end 223A of the component 220.

An outer circumference face of the cap 230 has a waterproof seal 239 with ridges and grooves, and the seal 239 is located between the male thread 231 and the O-ring 240 in the axis direction. The seal 239 seals a space between the inner circumference face of the component 220 and the outer circumference face of the cap 230 in the radial direction in an area between the male thread 231 and the O-ring 240. Therefore, water invasion from outside can be prevented from entering the space.

The filter portion 250 is made of the same resin material as the cap 230, and is integrally fitted to the tip end of the cap 230. The filter portion 250 has a main frame 252 and a net 251F. The main frame 252 is a based frame having an opening. A base of the main frame 252 is connected to the tip end of the cap 230, and the opening is located adjacent to the separator 260 opposite from the cap 230.

Inside space of the main frame 252 is divided in the circumference direction. Plural holes 252*a* are defined on the outer circumference face of the main frame 252, and each of the divided spaces communicates with outside through the hole 252*a*. The number of the divided spaces or the holes

252*a* is four, for example. A tip side of the main frame 252 adjacent to the opening has a taper 252*b*, and an outer diameter dimension of the taper 252*b* is made smaller as extending to the tip end of the main frame 252. The opening of the filter portion 252 on the tip side is defined as an opening 252*c*.

The net 251F is constructed by fine mesh, and is connected to the inner circumference face of the main frame 252 so as to cover the hole 252*a* of the main frame 252.

The separator 260 is a ring-shaped board member, and is arranged on the tip end of the filter portion 250. As shown in FIG. 14, an inner hole 261 is defined at the center of the separator 260. An inner circumference face of the hole 261 has a taper 261*a*, and the inner diameter dimension is made smaller as extending to the tip end of the filter portion 250. The tip end of the filter portion 250 is fitted with the inner hole 261 of the separator 260, and the taper 252*b* is engaged with the taper 261*a*. An outer circumference face of the separator 260 is connected to the inner circumference face of the tank 210. A space between the inner face of the tank 210 and the outer face of the filter portion 250 on the tip side is closed by the separator 260.

In the seventh embodiment, liquid refrigerant flows into the net 251F from the opening 252*c* of the filter portion 250, and passes into the header tank 120 through the hole 252*a*, 212.

According to the seventh embodiment, the separator 260 is arranged between the inner face of the tank 210 and the outer periphery of the main frame 252 on the tip side. Therefore, refrigerant in the tank 210 is introduced into the main frame 252 without passing through the outer periphery side of the main frame 252, and the introduced refrigerant passes through the net 251F with reliability.

In a conventional art, an internal thread component holds an end of a filter portion, and a space between an outer periphery of the filter portion on the tip side and an inner face of a tank is closed by the internal thread component.

Compared with the conventional art, according to the seventh embodiment, total length of the component 220 can be made short by the length corresponding to the filter portion 250, so that the weight and cost of the component 220 can be reduced.

The cap 230 and the main frame 252 of the filter portion 250 are made of resin material, and are integrally molded with each other. Therefore, the cap 230 and the main frame 252 are inserted into the component 220 at the same time, so that the number of assembling processes can be reduced.

Further, the taper 252*b* is defined on the tip end of the main frame 252, and the taper 261*a* is defined on the inner circumference face of the hole 261 of the separator 260. Therefore, the tip side of the main frame 252 can be easily fitted with the hole 261 of the separator 260, due to the tapers 252*b*, 261*a* when the cap 230 is inserted into the component 220.

Alternatively, the taper 252*b*, 261*a* may be eliminated.

(Eighth Embodiment)

Figure 15:
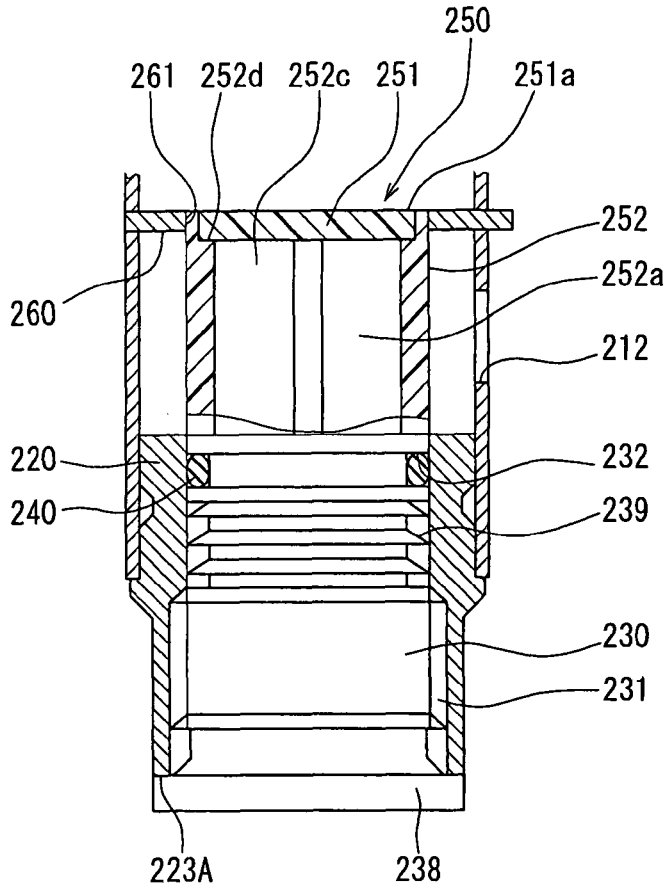
FIG. 15 is a cross-sectional view illustrating a cap and a filter portion of a receiver according to an eighth embodiment.

An eighth embodiment will be described with reference to FIG. 15 that illustrates a cap 230 and a filter portion 250. The shape of the net 251F of the seventh embodiment is modified into a net 251 in the eighth embodiment.

The net 251 is made of the same resin material as the cap 230, and has a disc shape, similarly to the first embodiment. A recess 252*d* is defined in the main frame 252 around the opening 252*c*. An inner diameter of the recess 252*d* is set greater than that of the opening 252*c*. The recess 252*d* defines a predetermined amount of step recessed in the axis direction. The net 251 has the flat disc shape, and is fitted into the recess 252*d*. The net 251 is inserted into the recess 252*d* so as to cover the opening 252*c*, and outer periphery 251*a* of the net 251 is welded to the recess 252*d* of the main frame 252.

Liquid refrigerant flows into the filter portion 250 through the opening 252*c* and the net 251, and flows out of the filter portion 250 through the hole 252*a*, 212 into the left header tank 120.

The net 251 has a simple shape and a small size. When the net 251 is welded to the main frame 252 of the filter portion 250, the positioning of the net 251 can be performed using the recess 252*d*, so that the welding can be easily performed.

Alternatively, the recess 252*d* may be eliminated.

(Ninth Embodiment)

Figure 16:
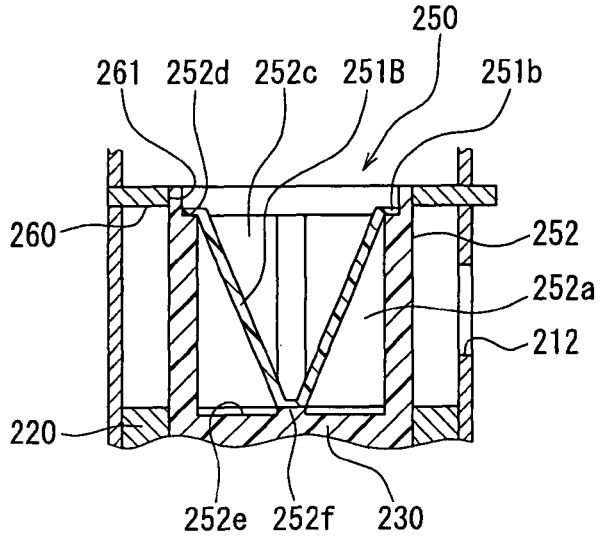
FIG. 16 is a cross-sectional view illustrating a filter portion of a receiver according to a ninth embodiment.

A ninth embodiment will be described with reference to FIG. 16 that illustrates a cap 230 and a filter portion 250. The shape of the net 251F of the seventh embodiment is modified into a net 251B in the ninth embodiment.

Figure 7:
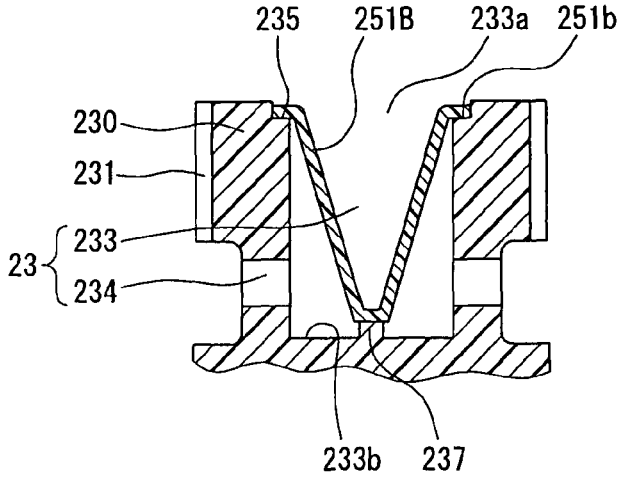
FIG. 7 is a cross-sectional view illustrating a cap of a receiver according to a third embodiment.

The net 251B is made of the same resin material as the cap 230, and has a cone shape, similarly to FIG. 7 of the third embodiment. The net 251B has a flange 251*b* extending outward in the radial direction from outer periphery of bottom side of the net 251B.

A recess 252*d* is defined in the main frame 252 around the opening 252*c*. An inner diameter of the recess 252*d* is set greater than that of the opening 252*c*. The recess 252*d* defines a predetermined amount of step recessed in the axis direction. The flange 251*b* of the cone-shaped net 251B is fitted into the recess 252*d*. Further, a projection 252*f* is projected from a center of inner bottom face 252*e* of the main frame 252 toward the opening 252*c*.

The flange 251*b* is inserted and welded to the recess 252*d*. A top end of the cone-shaped net 251B is welded to the projection 252*f*, thereby the net 251B is connected into the main frame 252 of the filter portion 250.

Liquid refrigerant flows into the net 251B from the opening 252*c* of the filter portion 250, and passes into the left header tank 120 through the hole 252*a*, 212.

According to the ninth embodiment, the positioning of the net 251B can be easily performed by inserting the flange 251*b* into the recess 252*d*, so that the net 251B is easily welded to the main frame 252 of the filter portion 250.

Further, the welding is performed in a state that the top end of the net 251B is contacted with the projection 252*f*, so that the cone-shaped net 251B can be fixed in stable state. Further, it is easy to focus and concentrate to the projection 252*f* as the welding position, and the welding of the top end of the net 251B can be easily performed.

Alternatively, the flange 251*b*, the recess 252*d* and the projection 252*f* may be eliminated.

(Tenth Embodiment)

Figure 17A:
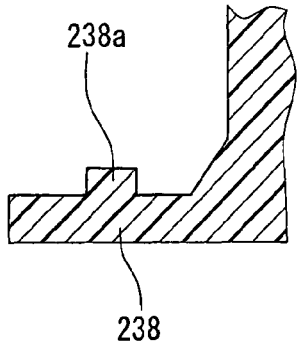
FIG. 17A is a cross-sectional view illustrating a flange of a cap of a receiver according to a tenth embodiment.

A cap 230 of a tenth embodiment is shown in FIG. 17A. A flange 238 of the cap 230 has a projection 238*a* relative to the seventh to ninth embodiments.

Figure 17B:
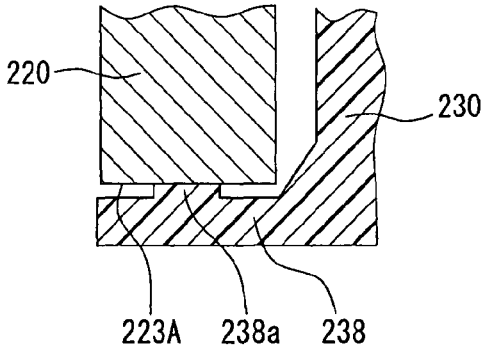
FIG. 17B is a cross-sectional view illustrating the flange and an internal thread component of the receiver of the tenth embodiment.

The projection 238*a* is located to oppose to the rear end 223A of the internal thread component 220. When the cap 230 is mounted to the component 220, the projection 238 contacts the rear end 223A. At this time, the shape of the projection 238 is changed into flat shape, as shown in FIG. 17B. Alternatively, the shape of the projection 238 may not be changed, while the clearance between the component 220 and the cap 230 is sealed.

According to the tenth embodiment, the projection 238*a* is contacted to the rear end 223A, so that pressure between the component 220 and the cap 230 is increased compared with a case where the whole face of the flange 238 contacts the rear end 223A. Thus, the sealing property can be raised. Accordingly, water can be restricted from entering the space between the component 220 and the cap 230, so that the inner face of the component 220 can be restricted from having corrosion.

(Eleventh Embodiment)

Figure 18:
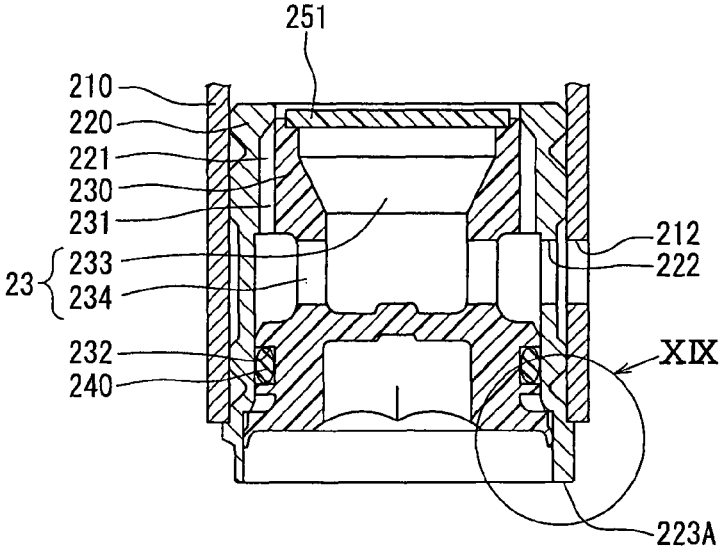
FIG. 18 is a cross-sectional view illustrating a cap of a receiver according to an eleventh embodiment.

An internal thread component 220 and a cap 230 of an eleventh embodiment is shown in FIG. 18. In the eleventh embodiment, a shape of the rear (lower) end 223 of the component 220 is modified into a rear end 223A, and the seal 239 of the cap 230 is modified into a waterproof seal 239A, compared with the first embodiment.

Figure 19:
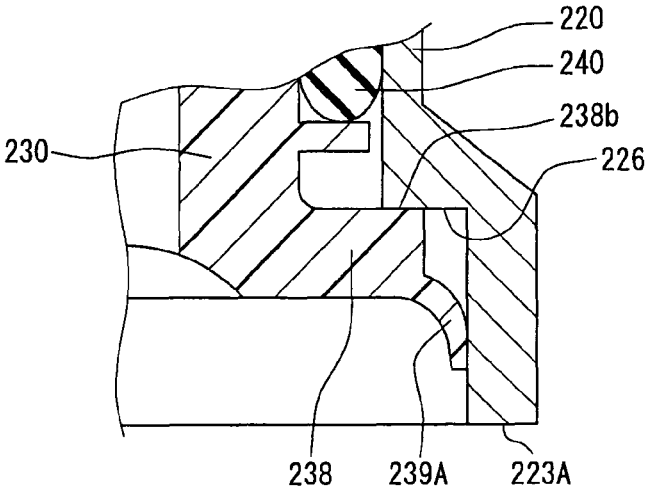
FIG. 19 is an enlarged view of an area XIX of FIG. 18.

The rear end 223A of the component 220 is a plane approximately perpendicular to the axis direction. The rear end 223A is located at a position protruding outward from the opening of the tank 210. Further, as shown in FIG. 19, an inner circumference face of the component 220 has a step 226 at a position between the rear end 223A and the O-ring 240 in the axis direction. An inner diameter of the component 220 adjacent to the O-ring 240 is set smaller than an inner diameter of the component 220 adjacent to the rear end 223A.

The lower end of the cap 230 has a flange 238. A face of the flange 238 opposing the O-ring 240 is defined as a contact potion 238*b*, and the contact portion 238*b* contacts the step 226. A clearance is defined between an outer face of the flange 238 and an inner face of the component 220 in the radial direction.

The seal 239A is arranged around outer periphery of the flange 238, and is integrally molded with the cap 230 with the same resin material. The seal 239A protrudes from the outer periphery of the flange 238 toward the inner face of the component 220, and a tip end of the seal 239A is bent in a direction opposing to outside, that is opposite from the inserting direction of the cap 230. Before the cap 230 is mounted to the component 220, a dimension of the seal 239A in the radial direction is set larger than a clearance dimension between the outer face of the flange 238 and the inner face of the component 220 opposing with each other. The tip end of the seal 239A is distorted and contacted to the inner face of the component 220 so as to seal the clearance between the inner face of the component 220 and the outer face of the flange 238. Thus, water is restricted from entering the clearance from outside. The flange 238 and the seal 239A are shaped to be located more inside of the component 220. The seal 239A may be made of resin material whose hardness is lower than the resin material for producing the cap 230, and may be integrally produced with the cap 230 using double injection.

According to the eleventh embodiment, water can be restricted from entering a space between the rear end 223A and the O-ring 240 in the component 220, due to the seal 239A. Therefore, the inner face of the component 220 can be restricted from having corrosion.

Because the tip end of the seal 239A is distorted in the opposite direction from the inserting direction, resistance generated when the cap 230 is inserted into the component 220 can be made smaller. A force necessary for inserting the cap 230 can be made small, and the cap 230 can be easily assembled.

Figure 20:
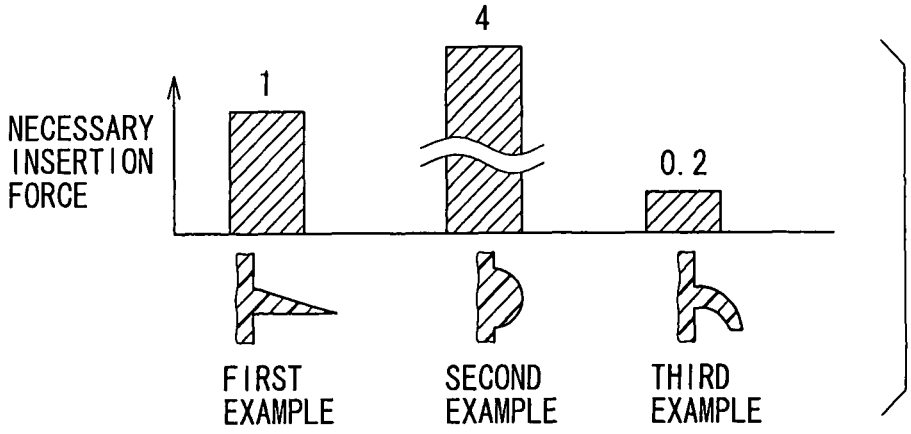
FIG. 20 is a comparison of force necessary for inserting the cap into an internal thread component of the eleventh embodiment.

FIG. 20 shows comparison of the forces necessary for inserting the cap 230 when the shape of the seal 239A is changed in three ways. A first example is the seal 239 of the first embodiment. A second example is a seal having semicircle cross-section. A third example is the seal 239A of the present embodiment. The force necessary for inserting the cap 230 is measured twenty times using twenty samples (n=20) and average is calculated from the twenty data. When the insertion force of the first example is defined as one, the insertion forces of the second and third examples are indicated as comparison index of the first example. As shown in FIG. 20, according to the present embodiment, the insertion force can be reduced by about 80% compared with the first example.

Figure 21:
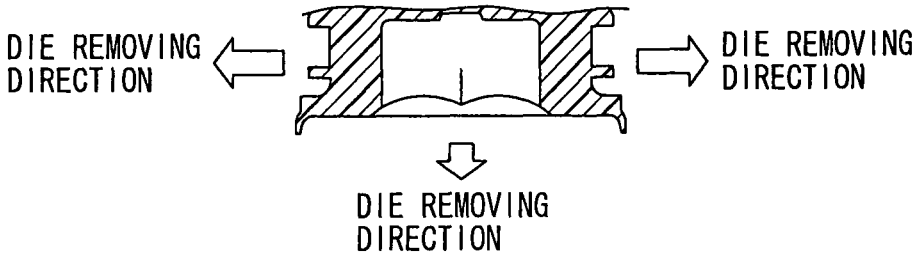
FIG. 21 is an explanatory view illustrating die removing directions in the eleventh embodiment.

The seal 239A is arranged around the outer periphery of the flange 238 of the cap 230. Therefore, when the cap 230 and the seal 239A are integrally molded using a die, a removing direction of the die can be suitably set, as shown in FIG. 21. The molding can be performed without increasing the number of producing processes.

(Twelfth Embodiment)

Figure 22:
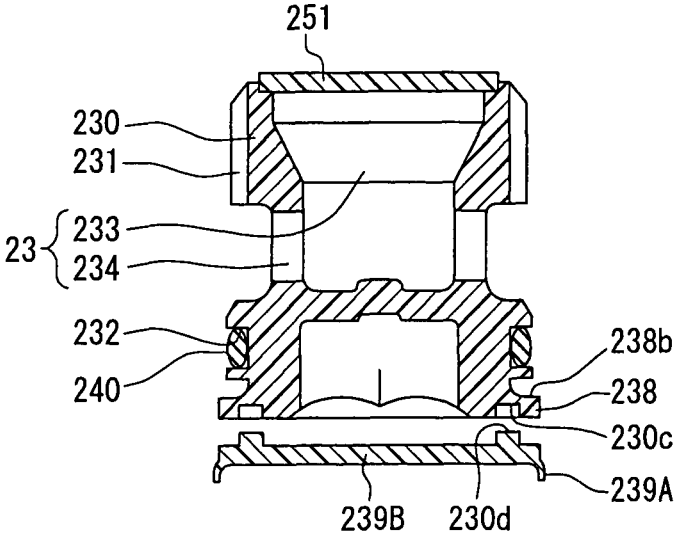
FIG. 22 is a cross-sectional view illustrating a cap of a receiver according to a twelfth embodiment.

A cap 230 of a twelfth embodiment is shown in FIG. 22. In the twelfth embodiment, a waterproof portion 239B is produced separately from the cap 230, and has the seal 239A, compared with the eleventh embodiment.

The cap 230 does not have the seal 239A. A lower end face of the cap 230 opposite from the contact face 238*b* of the flange 238 has a recess 230*c* extending in the circumference direction.

The waterproof portion 239B has a disc shape having approximately the same outer diameter with the flange 238, and is made of the same material as the cap 230. The seal 239A is integrally formed with the outer periphery of the waterproof portion 239B. The waterproof portion 239B is arranged to oppose to the lower end face of the flange 238. A face of the waterproof portion 239B opposing to the flange 238 has a projection 230*d* fitted with the recess 230*c*. A dimension of the projection 230*d* in the radial direction is slightly larger than a dimension of the recess 230*c* in the radial direction. The waterproof portion 239B is connected to the cap 230 by fitting the recess 230*c* and the projection 230*d*, so that the cap 230 can be produced, similarly to the eleventh embodiment. If the recess 230*c* and the projection 230*d* are disconnected from each other, that is if the waterproof portion 239B is removed from the cap 230, the cap 230 can be made not to have the seal 239A. The waterproof portion 239B may be made of a resin material whose hardness is lower than the resin material used for the cap 230.

In an environment where the sealing property is not so much necessary, the waterproof portion 239B may be removed from the cap 230. In this case, the seal 239A can be eliminated, and waterproof function of the receiver 200 can be suitably set considering the necessity and the cost.

(Thirteenth Embodiment)

Figure 23:
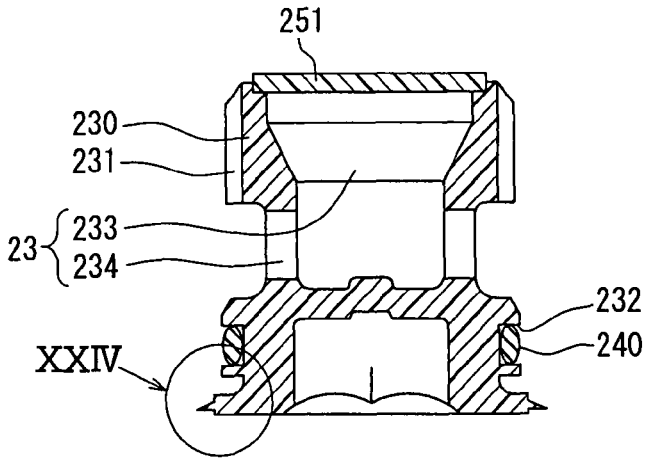
FIG. 23 is a cross-sectional view illustrating a cap of a receiver according to a thirteenth embodiment.

A cap 230 of a thirteenth embodiment is shown in FIG. 23. In the thirteenth embodiment, as shown in FIG. 24A, the waterproof seal 239A is changed into a waterproof seal 239C, compared with the eleventh embodiment.

Figure 24A:
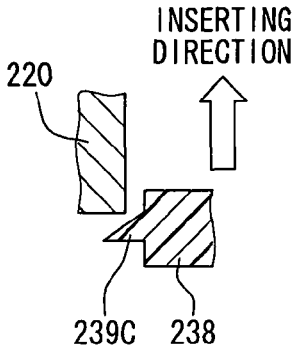
FIGS. 24A and 24B are enlarged cross-sectional views of an area XXIV of FIG. 23.
Figure 24B:
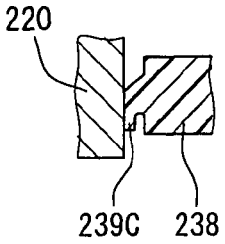

As shown in FIG. 24A, the seal 239C protrudes from the outer face of the flange 238 toward the inner face of the component 220. Before the cap 230 is mounted to the component 220, a dimension of the seal 239C in the radial direction is set larger than a clearance dimension between the outer face of the flange 238 and the inner face of the component 220 opposing with each other. When the tip end of the seal 239C contacts the inner face of the component 220, the shape of the seal 239C is bent, as shown in FIG. 24B, so as to seal the clearance between the inner face of the component 220 and the outer face of the flange 238. Thus, water is restricted from entering the clearance from outside. The seal 239C may be made of resin material whose hardness is lower than the resin material used for producing the cap 230, and may be integrally produced with the cap 230 using double injection.

According to the thirteenth embodiment, the sealing is performed by the change of the shape of the seal 239C, so that pressure between the component 220 and the flange 238 can be raised compared with a case where the whole surfaces are contact with each other. Thus, the sealing property can be raised. Accordingly, water can be restricted from entering a space between the component 220 and the cap 230, so that the inner face of the component 220 can be restricted from having corrosion.

(Fourteenth Embodiment)

Figure 25:
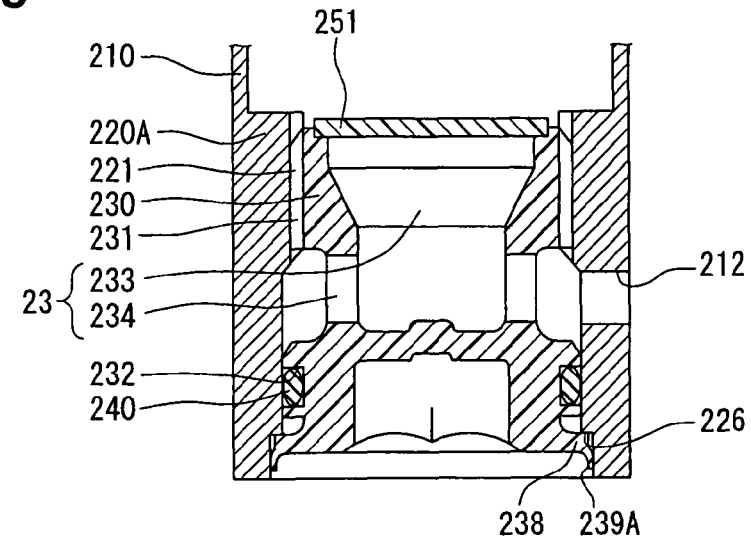
FIG. 25 is a cross-sectional view illustrating an internal thread component of a receiver according to a fourteenth embodiment.

A fourteenth embodiment will be described with reference to FIG. 25, in which an internal thread 221 is directly defined on the tank 210 compared with the first to thirteenth embodiments, so that the internal thread component 220 is eliminated.

As an internal thread component 220A, a thickness of part of the tank 210 adjacent to the opening is larger than that of the other part. That is, a portion of the tank 210 corresponding to the component 220 of the first to thirteenth embodiment is made to have a thickness larger than that of the other part so as to define the component 220A. Similarly to the component 220, a hole 212, a male thread 221, a face sealed with the O-ring 232, a step 226 and a face sealed with the seal 239A are defined in the component 220A.

According to the fourteenth embodiment, the component 220 can be eliminated. Therefore, the number of assembling parts and the number of producing processes can be reduced, so that cost for producing the receiver 200 can be reduced.

(Fifteenth Embodiment)

A receiver-integrated condenser 10A of a fifteenth embodiment will be described with reference to FIG. 26. Compared with the second embodiment, upside and downside are exchanged with each other in the fifteenth embodiment.

Conventionally, in a condenser having a condensation part and a supercooling part, high-temperature air passing through the condenser and a radiator may flow again upstream of the condenser by passing through the lower side of the condenser. In this case, if temperature of outside air that cools refrigerant in the condenser is higher on the lower side than the upper side, the cooling effect of the supercooling part located on the lower side is lowered.

Figure 26:
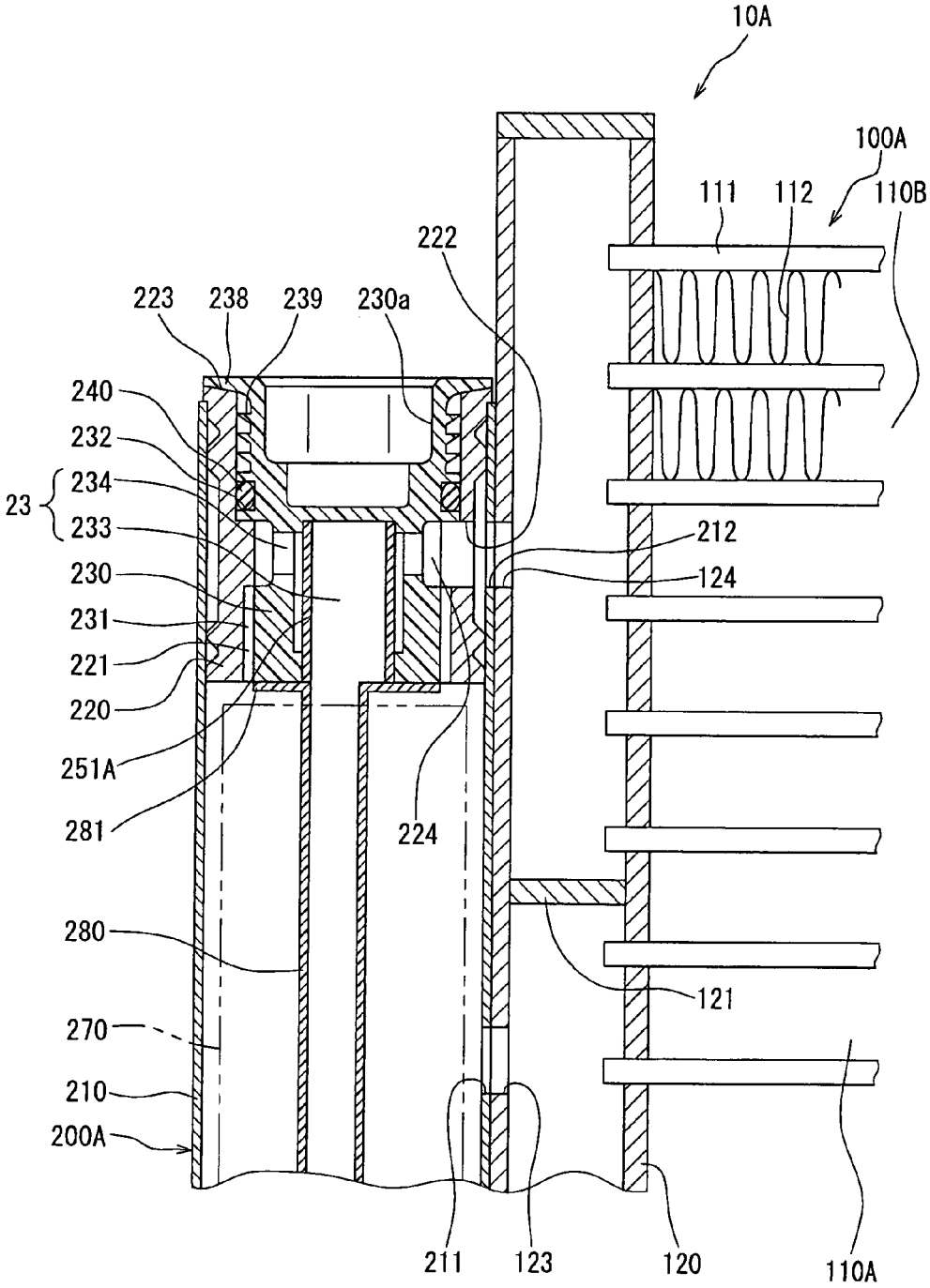
FIG. 26 is a schematic cross-sectional view illustrating a receiver-integrated condenser according to a fifteenth embodiment.

Therefore, as shown in FIG. 26, the condensation part 110A is located on the lower side of the condenser 100A, and the supercooling part 110B is located above the condensation part 110A. Depending on positions of inlet and outlet connectors (not shown), refrigerant flows through the supercooling part 1108 after flowing through the condensation part 110A.

Accordingly, the opening of the tank 210 is located on the upper side in the receiver 200A, and the internal thread component 220 and the cap 230 are mounted to the opening located on the upper side. Constructions of the component 220 and the cap 230 are changed in the fifteenth embodiment in a manner that upside and downside are exchanged in the second embodiment. The net 251A of the cap 230 has a tube shape and is connected to inside of the first passage 233.

However, liquid refrigerant stays on the lower side of the tank 210, so that a pipe 280 is arranged in the cap 230. The bottom side of the tank 210 is connected to the first passage 233 of the internal passage 23 inside the cap 230 by the pipe 280. An upper end of the pipe 280 has a flange 281, and the flange 281 is connected to the axial end of the cap 230.

In FIG. 26, refrigerant condensed in the condensation part 110A passes through the hole 123 of the left header tank 120 and the hole 211 of the tank 210, and stays in the tank 210. Due to internal pressure of the tank 210, refrigerant flows into the first passage 233 from the lower side of the tank 210 through the pipe 280. Refrigerant flowing into the first passage 233 passes through the net 251A, the second passage 234, and flows into the tank 120 through the hole 212.

Approximately the same advantages can be obtained in the present embodiment, as the second embodiment.

The net 251A may be the net 251, 251B, 251C, 251D or 251E.

(Other Embodiment)

Figure 27:
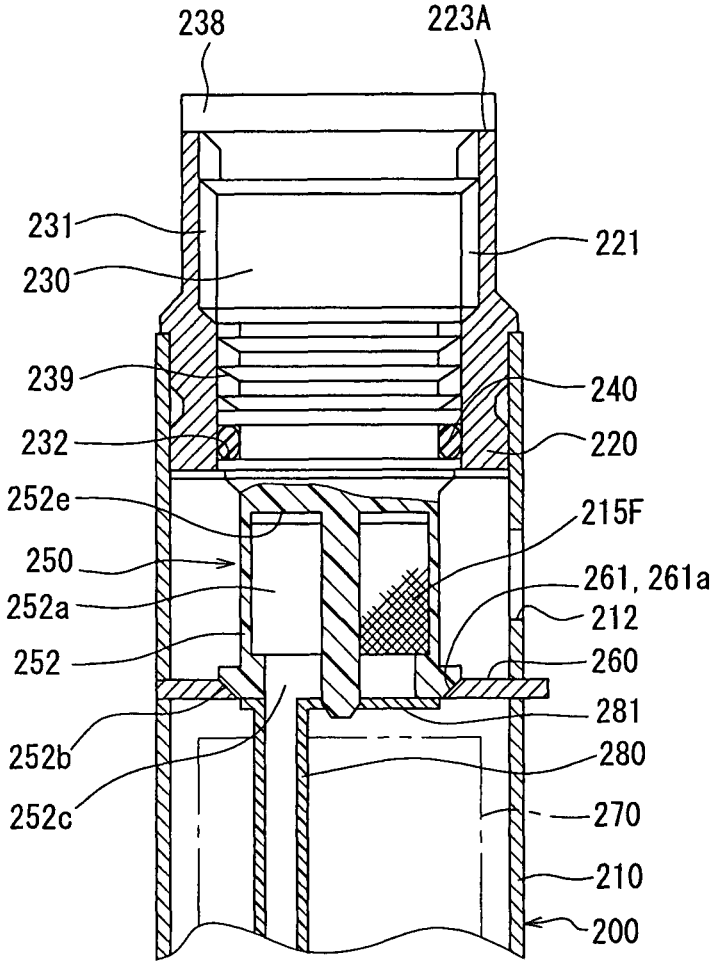
FIG. 27 is a schematic cross-sectional view illustrating a receiver-integrated condenser according to other embodiment.

In a case where the internal thread component 220 and the cap 230 are arranged on the upper side of the tank 210, as shown in FIG. 27, the upside and the downside may be exchanged in the seventh embodiment. In this case, the filter portion 250 has the pipe 280. Furthermore, the upside and the downside may be exchanged in the eighth embodiment or the ninth embodiment.

The prevent invention is not limited to the receiver-integrated condenser 10, 10A, and may be applied to the receiver 200, 200A produced separately from the condenser 100, 100A.

The core part 110 of the condenser 100 is not limited to have both of the condensation part 110A and the supercooling part 110B, and may have only the condensation part 110A. In this case, liquid refrigerant separated from gas refrigerant in the receiver 200 is set to be discharged into the expansion valve of the refrigerating cycle.

The cap 230, the main frame 252 of the filter portion 250, and the net 251, 251A-251F may be made of metal material instead of the resin material.

The cap 230 may be bonded to the net 251, 251A-251E using adhesive, and the main frame 252 of the filter portion 250 may be bonded to the net 251F, 251, 251B using adhesive.

In the seventh to eleventh embodiments, the internal thread 221 may be located on the upper side of the component 220 in the axis direction. Further, the O-ring 240 may be located on the lower side of the cap 230, and the male thread 231 may be located on the upper side of the cap 230 in the axis direction.

The cap 230 and the filter portion 250 may be produced separately from each other, and may be integrated using welding or adhesive.

Such changes and modifications are to be understood as being within the scope of the present invention as defined by the appended claims.

What is claimed is:

1. A receiver for separating refrigerant into gas and liquid comprising:

a cylindrical main tank having an opening at a longitudinal end;

a cylindrical internal thread component having an internal thread on an inner circumference face of an end portion in an axis direction, the component being coaxially arranged to an inner circumference face of the tank adjacent to the opening in a manner that the internal thread is located on an inner side of the opening in the axis direction;

a cap coaxially mounted to the component, the cap having a male thread on an outer circumference face of an end portion in the axis direction, the male thread being threaded with the internal thread;

a sealing mounted to the cap, wherein the sealing seals a clearance between an inner circumference face of the other end portion of the component and an outer circumference face of the other end portion of the cap; and a filter portion defined in the cap, the filter portion collecting a foreign matter contained in liquid refrigerant while the liquid refrigerant passes through the filter portion before flowing out of the tank, wherein the filter portion includes an internal passage extending inside of the cap from an axial end of the cap to outside of the cap located between the male thread and the sealing in the axis direction, a net that collects the foreign matter contained in liquid refrigerant while the liquid refrigerant flows through the internal passage; and the cylindrical main tank has a first through hole through which refrigerant flows into the cylindrical main tank and a second through hole communicating with the internal passage of the filter portion so as to cause the refrigerant to flow out of the cylindrical main tank.

2. The receiver according to claim 1, wherein the internal thread component and the main tank are produced separately from each other, the internal thread component is coaxially arranged in the main tank by being inserted, and the internal thread component is joined to the inner circumference face of the main tank adjacent to the opening.

3. The receiver according to claim 1, wherein the net has a flat shape, and is arranged on the axial end of the cap so as to cover an opening of the internal passage.

4. The receiver according to claim 3, wherein the axial end of the cap has a recess adjacent to the opening of the internal passage, and the net is fitted to the recess.

5. The receiver according to claim 1, wherein the internal passage has a first passage extending from the axial end of the cap to a middle of the cap in the axis direction, and a second passage communicating with the first passage, the second passage having a first opening on the outer circumference face of the cap and a second opening on the inner circumference face of the cap, the net has a cylindrical shape and is arranged in the first passage so as to cover the second opening of the second passage, and the net has axial ends in the axis direction, and the axial ends of the net are connected to an inner wall of the first passage.

6. The receiver according to claim 5, wherein the cap has a projection projected from the inner wall of the first passage in a radial direction of the first passage, the projection is located on at least one of positions corresponding to the axial ends of the net, and extends in a circumference direction, the axial ends of the net are connected to the projection or the inner wall of the first passage, and a clearance is defined between the net and the inner wall of the first passage.

7. The receiver according to claim 1, wherein the internal passage has a first passage extending from the axial end of the cap to a middle of the cap in the axis direction, and a second passage communicating with the first passage, and the net has a cone shape, and an outer periphery of a bottom face of the cone-shaped net is connected to the axial end of the cap adjacent to the opening of the first passage.

8. The receiver according to claim 7, wherein the cap has a termination wall at a termination of the first passage, and a tip end of the cone-shaped net is connected to the termination wall.

9. The receiver according to claim 7, wherein the outer periphery of the bottom face of the cone-shaped net has a flange extending outward in the radial direction, the axial end of the cap has a recess adjacent to the opening of the internal passage, and the flange is fitted to the recess.

10. The receiver according to claim 1, wherein the cap is made of resin material.

11. The receiver according to claim 1, wherein the cap and the net are made of resin material, and the net is welded to the cap.

12. The receiver according to claim 11, wherein the cap has a projection projected toward the net from a position to which the net is welded, and the net is welded to the projection.

13. The receiver according to claim 1, wherein the cap has a rear end that is located at rear in an inserting direction when the cap is inserted into the internal thread component, the rear end of the cap has a flange protruding outward in the radial direction, the flange has a projection projected in the inserting direction from a face of the flange opposing to the component, and the flange is contacted with an axial end of the component so that a clearance between the face of flange and the axial end of the component is sealed.

14. The receiver according to claim 1, wherein the cap has a rear end that is located at rear in an inserting direction when the cap is inserted into the internal thread component, the outer circumference face of the cap has a waterproof seal located between the rear end of the cap and the sealing in the axis direction, and the waterproof seal is projected toward the inner circumference face of the component so as to seal a clearance between the outer circumference face of the cap and the inner circumference face of the component.

15. The receiver according to claim 1, wherein the cap has a rear end that is located at rear in an inserting direction when the cap is inserted into the internal thread component, an outer periphery of the rear end has a waterproof seal projected toward the inner circumference face of the component so as to seal a clearance between the outer circumference face of the cap and the inner circumference face of the component.

16. The receiver according to claim 15, wherein the waterproof seal has a tip end opposing to the component, and the tip end is distorted in a direction opposite from the inserting direction.

17. The receiver according to claim 15, wherein the waterproof seal and the cap are produced separately from each other, the cap has a fitting part to be fitted with a fitting part of the seal, and the seal is detachable from the cap by removing the fitting parts from each other.

18. The receiver according to claim 1, wherein the cap has a rear end that is located at rear in an inserting direction when the cap is inserted into the internal thread component, an outer periphery of the rear end has a waterproof seal projected toward the inner circumference face of the component, and a projecting tip of the seal is contacted with the inner circumference face of the component so as to seal a clearance between the outer circumference face of the cap and the inner circumference face of the component.

19. The receiver according to claim 14, wherein the cap and the seal are made of resin material, and are molded integrally or using double injection.

20. A receiver-integrated condenser comprising the receiver according to claim 1 and a condenser that condenses refrigerant.

21. The receiver according to claim 1, wherein the internal passage has a first passage extending from the axial end of the cap to a middle of the cap in the axis direction, and a second passage communicating with the first passage, and the filter portion, the first passage and the second passage are arranged in this order in a flowing direction of the liquid refrigerant.

22. The receiver according to claim 1, wherein the net is disposed within a recess formed in the cap.

23. The receiver according to claim 22, wherein the internal passage extends into the cap from the recess.

24. The receiver according to claim 1, wherein the internal thread of the cylindrical internal thread component is disposed inside the cylindrical main tank.

25. The receiver according to claim 1, wherein the filter portion is entirely disposed within the cylindrical main tank.

26. A receiver for separating refrigerant into gas and liquid comprising:

a cylindrical main tank having an opening at a longitudinal end;

a cylindrical internal thread component having an internal thread on an inner circumference face of an end portion in an axis direction, the component being coaxially arranged to an inner circumference face of the tank adjacent to the opening in a manner that the internal thread is located on an inner side of the opening in the axis direction;

a cap coaxially mounted to the component, the cap having a male thread on an outer circumference face of an end portion in the axis direction, the male thread being threaded with the internal thread;

a sealing mounted to the cap, wherein the sealing seals a clearance between an inner circumference face of the other end portion of the component and an outer circumference face of the other end portion of the cap;

an internal passage extending inside of the cap from an axial end of the cap to outside of the cap located between the male thread and the sealing in the axis direction, and a net that collects foreign matter contained in liquid refrigerant while the liquid refrigerant flows through the internal passage, the net being disposed at the axial end of the cap, liquid refrigerant flowing through the net and into the internal passage.

27. The receiver according to claim 26, wherein the net is disposed within a recess formed in the cap.

28. The receiver according to claim 27, wherein the internal passage extends into the cap from the recess.

* * * * *